United States Patent [19]

Lennard

[11] Patent Number: 4,470,720

[45] Date of Patent: Sep. 11, 1984

[54] UNDERWATER TRENCHING & PIPELAYING APPARATUS

[76] Inventor: Eddie Lennard, 2601 Danbury, New Orleans, La. 70114

[21] Appl. No.: 306,285

[22] Filed: Sep. 28, 1981

[51] Int. Cl.[3] ..... F16L 1/04; E02F 3/88

[52] U.S. Cl. ..... 405/161; 405/162; 405/164; 37/66

[58] Field of Search ..... 405/159, 161, 162, 164, 405/163, 180–183; 37/60, 64, 66, 86, 87

[56] References Cited

U.S. PATENT DOCUMENTS

| | | | |
|---|---|---|---|
| 3,209,473 | 10/1965 | Davis | 37/86 |
| 3,238,734 | 3/1966 | Rhodes | 405/159 |
| 3,583,170 | 6/1971 | De Vries | 405/162 |
| 3,590,589 | 7/1971 | Smulders | 405/161 |
| 3,717,003 | 2/1973 | Bates | 405/162 |
| 3,751,927 | 8/1973 | Perot, Jr. | 405/162 X |
| 3,877,238 | 4/1975 | Chang et al. | 405/162 |
| 3,926,003 | 12/1975 | Norman | 405/162 |
| 3,952,532 | 4/1976 | Spearman | 405/164 |
| 4,274,760 | 6/1981 | Norman | 405/162 X |
| 4,295,757 | 10/1981 | Gaspar | 405/164 X |

*Primary Examiner*—Cornelius J. Husar
*Assistant Examiner*—Nancy J. Stodola
*Attorney, Agent, or Firm*—Bode & Smith

[57] ABSTRACT

The apparatus will include a support sled portion having a pair of spaced apart elongated pontoon sections. The pontoons are interconnected by a plurality of I-beam spacer members. A cutter apparatus, including an endless cutter chain projecting into the soil is mounted to the underside of the I-beam spacer members.

11 Claims, 6 Drawing Figures

UNDERWATER TRENCHING & PIPELAYING APPARATUS

BACKGROUND OF THE INVENTION

1. Field of the Invention

The present invention relates to underwater trenching apparatuses in general. In particular, the present invention relates to an apparatus for digging an underwater trench in hard bottom bodies of water with a mechanical cutter apparatus and simultaneously laying a continuous length of pipe in the trench as cut.

2. General Background

It is a common practice in the oil and gas industry that, in order to move oil or gas from offshore on to land, often time requires laying of pipe for transport of the oil or gas. Due to requirements by the Environmental Protection Agency or other government agencies, it is required that the underwater pipe be laid in a trench dug at the bottom of the body of water with the action of the water backfilling the trench subsequent to the laying of the pipe. In the present state of the art, most underwater trenching which is done in the softer bottom areas of the gulf and other bodies of water, is accomplished with the use of a underwater trenching apparatus utilizing a "jet sled" with highly compressed air or water being used as the trenching device, with the compressed air or water literally digging a trench in the hard or soft silt bottom which is then inlaid with a continuous row of pipe or the like.

However, often times in the laying of pipe, one comes across an area of the gulf or the body of water which has a very substantially solid bottom, such as shale or the like, which cannot be cut out with the use of a jet sled and the highly compressed air or water, due to the substantial layer of hard bottom. Therefore, a device must be utilized which mechanically cuts out the trench, with the use of augers or the like, in order to assure that the trench is cut for the laying of the pipe.

Several inventions have been patented which speak towards the mechanical device for trenching out a trench for laying of cables or pipe underwater. The most pertinent are as follows:

U.S. Pat. No. 3,925,532 issued to Spearman entitled "Underwater Trenching and Cable Laying Apparatus" would teach the use of a sled which supports a hydraulic motor drive digging wheel for cutting out a trench and feeding conduit in the trench for laying of conduit beneath the water. The apparatus utilizes a rotary digging wheel which would cut substantially a width of a trench necessary to lay a cable or the like, and does not address the problem of digging a substantially broad trench for the laying of pipe as in our particular apparatus.

U.S. Pat. No. 3,852,972 issued to Holberg entitled "Submerged Pipeline Burial Apparatus" would teach the use of a pipeline burial apparatus having a support structure carried along the pipeline by a movable carriage and includes a plurality of inclinded augers for cutting or digging beneath the pipe to which the pipe is to be laid. In this particular invention, the cutting means is the plurality of augers which are angulated down into the earth for cutting the trench wherein the pipe is to be laid.

U.S. Pat. No. 3,978,679 issued to Lecomte entitled "Method and Apparatus for Underwater Trench Excavation and Pipeline Laying" would teach the use of an apparatus for excavating a trench with the use of an excavation machine which moves alongside the pipeline and digs out material from beneath the pipeline. The patent discloses the cutting means as a rotary type of cutter at the end of an articulated arm for trenching out the area directly beneath the pipe as the pipe is set on the bottom of the body of water.

U.S. Pat. No. 3,238,734 issued to R. F. Rhodes entitled "Apparatus for Burying and Recovering Pipe in Underwater Locations" would teach the use of an apparatus having a pair of cuttings means set upon a chain or the like for excavating an area which would substantially house a pipe therewithin after the area has been excavated by the pair of trenching apparatuses. The apparatuses would have the ability to be angulated in towards one another for digging out a trench or the like for laying of the pipe therewithin.

Other patents which teach the use of trenching apparatuses are U.S. Pat. No. 3,412,490 issued to F. M. Reising entitled "Trenching Machine"; U.S. Pat.No. 737,021 issued to B. Roberts entitled "Submarine Cable Laying Device"; and U.S. Pat. 4,245,927 issued to Wharton entitled "Laying of Pipes or Cables in a Bed of Material".

SUMMARY OF THE INVENTION

The preferred embodiment of the apparatus of the present invention would solve the problems confronted in the present state of the art in a simple and straightforward manner. The apparatus of the present invention includes a support sled portion which comprises a pair of spaced apart elongated pontoon sections, with the pontoons connected by a plurality of I-beam spacer means, spaced along the top of the pontoons, and interconnecting them in a substantially rigid and parallel position to one another. There is mounted on the underside of several of the I-beam spacer means, substantially to the center of the pontoons, a cutter apparatus which includes a hydraulically operated motor means for driving an endless cutter chain mounted at its first end to a sprocket wheel with the wheel driving engaged by the hydraulic motor, and on its second end on a second sprocket wheel mounted at the distal end of a swivel arm, the cutter chain projecting downward into the soil between the pontoons for trenching out as the cutter chain is rotated. Also provided is a plurality of roller means set upon each of the I-beam spacer means for accompanying a length of pipe across the top of the I-beam spacer means, the end of the pipe laid at the bottom of the trench dug by the cutter means. There also, provided is a source of hydraulic power and a means for propelling the support sled along the bottom of the body of water during the cutting and pipe laying operations. There is further provided auger means for removing the trenched soil away from the cutter chain during the trenching operation. Further, there could be provided air lift means for removal of the debris away from the auger means.

Therefore, it is an object of the present invention to provide an apparatus for mechanically trenching into the bottom of a body of water;

It is a further object of the present invention to provide an apparatus for selectively trenching beneath bodies of water at various depths, depending on the angulation of a cutting means.

It is a further object of the present invention to provide an apparatus which mechanically trenches out the bottom of the body of water and simultaneously lays continuous section of pipe within the trench dugout;

It is a further object of the present invention to provide an apparatus for trenching beneath a body of water whereby the apparatus is propelled upon the bottom by an external force and receives its power from an external source;

It is a further object of the present invention to provide an apparatus including a means for receiving a continuous section of pipe and depositing the section of pipe in a trench dug posterior to the movement of the apparatus;

In order to accomplish the above objects, it is a feature of the apparatus to provide a hydraulically controlled cutting means mounted upon I-beam spacer means between a pair of spaced apart elongated pontoons;

It is a further feature of the apparatus of the present invention to provide a cutter means comprising an endless chain rotatingly mounted at one end at the end of a swivel arm for selectively cutting various depths as the endless chain is rotated;

It is a further feature of the present invention to provide a roller means so constructed to provide a path for receiving an endless section of pipe and depositing the section of pipe within a trench dug by the apparatus.

It is a further feature of the present invention to provide a means for suctioning the debris away from the cutter means during the trenching operation.

BRIEF DESCRIPTION OF THE DRAWINGS

For a further understanding of the nature and object of the present invention, reference should be had to the following detailed description taken in conjunction with the accompanying drawings in which like parts are given like reference numerals and, wherein.

DETAILED DESCRIPTION OF THE PREFERRED EMBODIMENT

Figure 1:
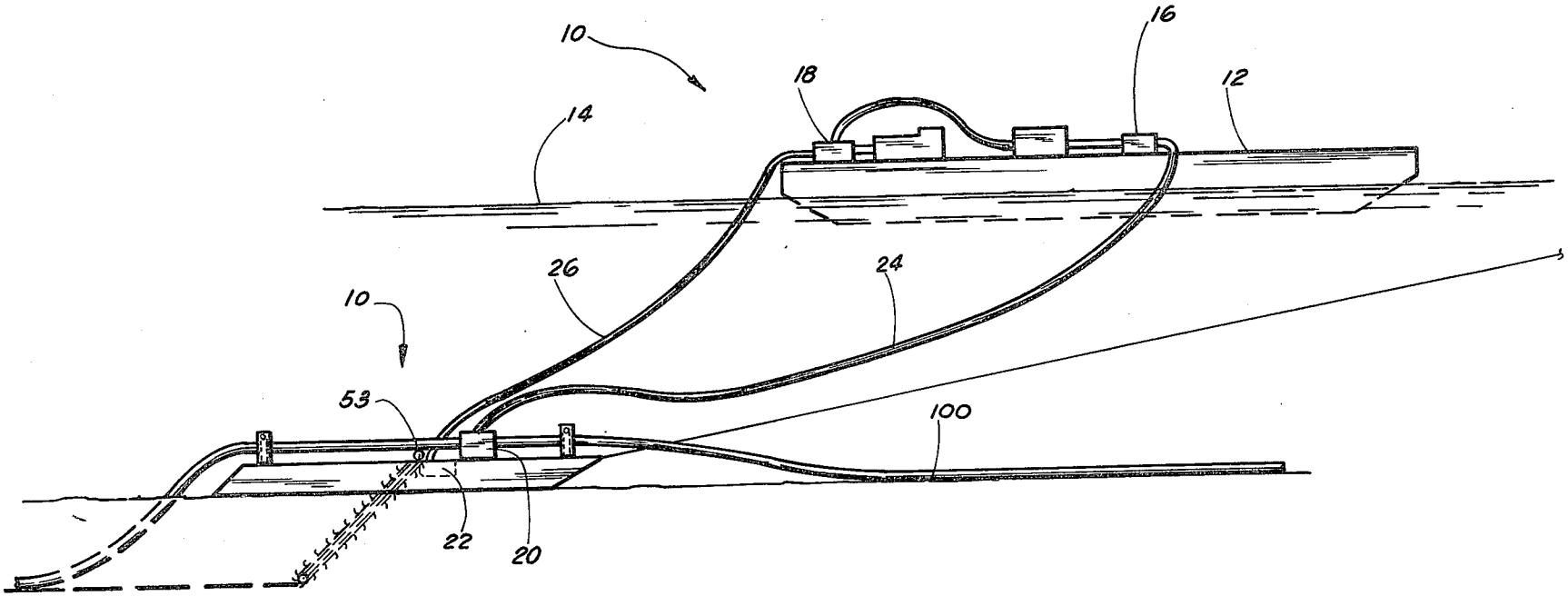
FIG. 1 is a side view of the preferred embodiment of the apparatus of the present invention further illustrating the floating barge.
Figure 2:
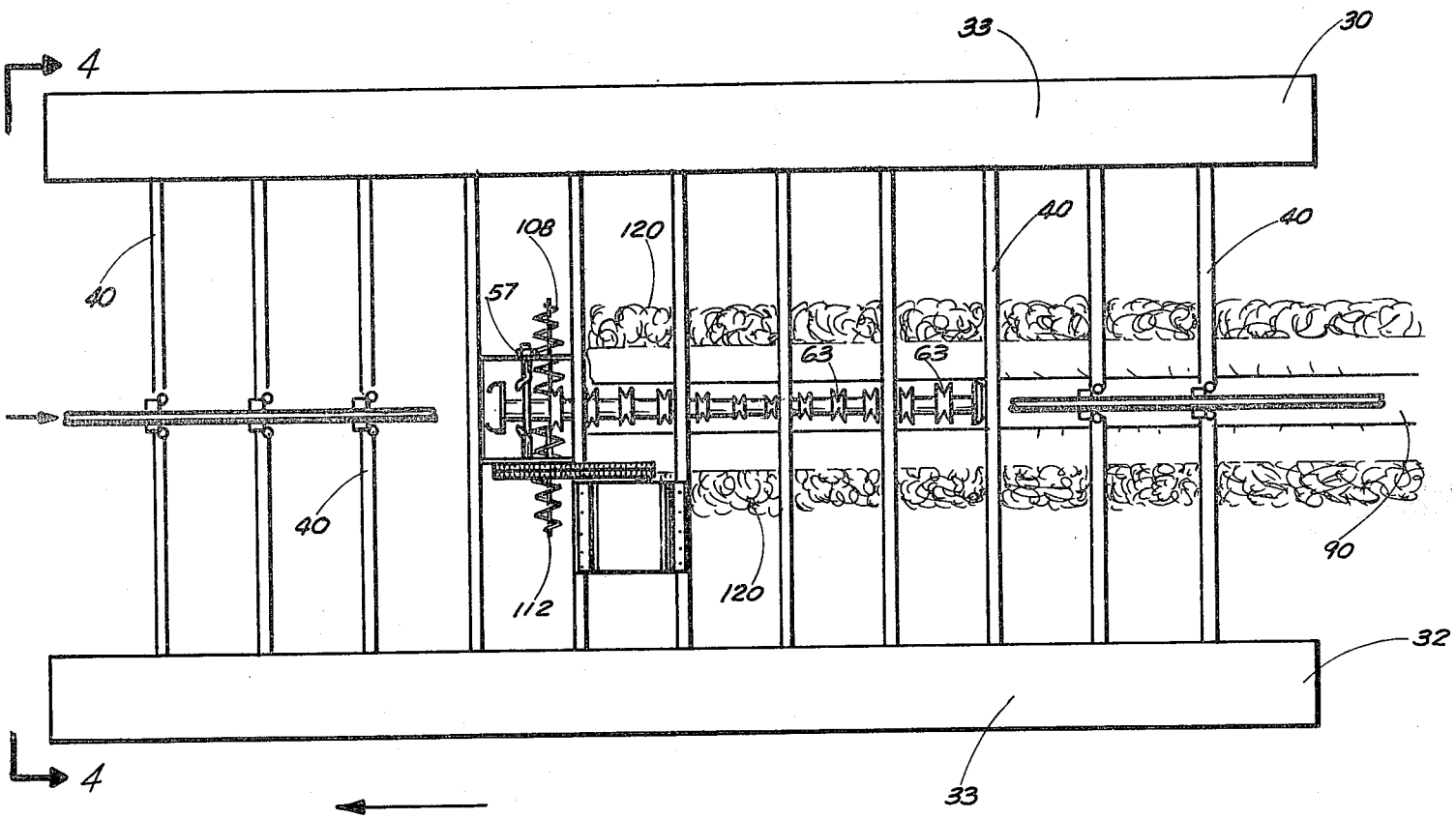
FIG. 2 is a top view of the preferred embodiment of the apparatus of the present invention.
Figure 3:
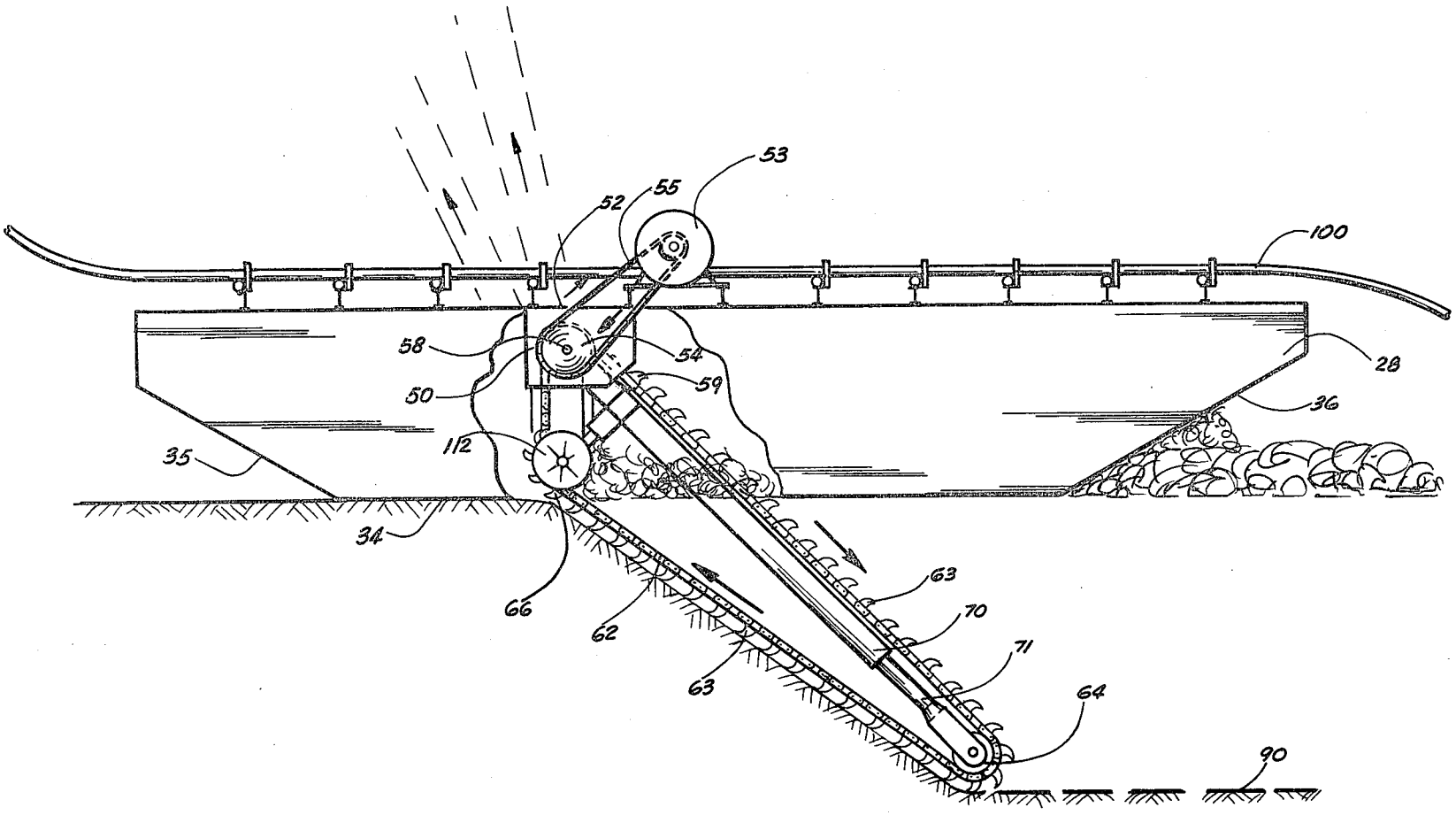
FIG. 3 is a side, partial cutaway view of the preferred embodiment of the apparatus of the present invention.

FIGS. 1 through 3 illustrate the preferred embodiment of the apparatus of the present invention generally designated by the numeral 10. The entire apparatus 10 comprises generally a floating barge means 12 which may be power driven or pulled by a boat or the like, along the top of the body of water 14. Barge 12 is equipped with a source for hydraulic power 16 and 18, each of said sources of hydraulic power 16 and 18 driving hydraulic motors 20 and 22 respectively, the function of which will be discussed further. Connecting hydraulic sources 16 and 18 with hydraulic motors 20 and 22 are a plurality of hydraulic lines 24 and 26, each of said pair of lines 24 and 26 serving to power each of the hydraulic motors 20 and 22 respectively.

Further illustrated in FIGS. 1 through 3 and, in particular, FIGS. 2 and 3, is sled means 28, which structurally is comprised of a pair of elongated pontoons 30 and 32 extending the length of sled means 28, each of said pontoons 30 and 32 being generally a closed wall structure generally parallel to one another with the upper surface 33 being generally parallel with the bottom 34 of the pontoons 30 and 32 for the majority of the length of the pontoons, with the bottom 34 angulating along lines 35 and 36 to form the front portion and rear portion of the sled respectively (See FIG. 3). This angulation of wall 35 and 36 helps to provide easier movement of sled 28 during the trenching process.

Further illustrated in FIGS. 2 and 3 are I-beam spacer means 40 which comprise a plurality of I-beams extending between each of pontoons 30,32 and rigidly connecting pontoons 30,32 together in substantially parallel fashion. I-beams 28 would extend between the upper portion 33 of each of the pontoons 30 and 32 be integrally connected at their end portions to pontoons 30 and 32 via welding or the like in order to effect a substantially rectangular sport sled 28. In the preferred embodiment, pontoons 30 and 32 would be approximately 16 feet in length and approximately 14 feet apart between spacer means 40. Each pontoon would be approximately 20 to 24 inches in height from bottom portion 34 to top portion 33.

Figure 6:
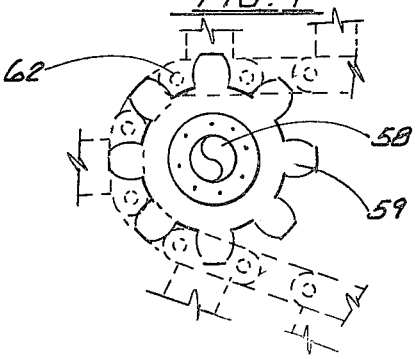
FIG. 6 is a side view along lines 5—5 in FIG. 4 of the driven sprocket in the preferred embodiment of the apparatus of the present invention.

As illustrated in FIG. 3, rigidly attached to at least two I-beam spacer means 40 is digging assembly 50, the top portion of which comprises a closed wall structure, having a top side 52 for rigidly attaching to a pair of I-beams 40 substantially along the mid portion of pontoons 30 and 32. Preferably, the attachment would be via bolting or the like or welding. Digging assembly 50, as illustrated in FIG. 3 in cutaway partial view would comprise a hyraulic motor 53 rigidly mounted upon I-beam spacer means 40, and driven by hydraulic power means 16 mounted upon floating barge 12, the power of which is supplied by lines 26 to hydraulic motor 53. Hydraulic motor 53 would be drivingly engaged to a sprocket wheel 54 via chain or belt 55 so that rotation of motor 53 would impart rotation of sprocket wheel 54. Sprocket wheel 54 would be mounted along shaft 58, shaft 58 extending across the entire width of enclosed structure 52 and supported at its second end within a bearing means in the wall of enclosed structure 50 (See FIG. 2). As seen in top view in FIG. 3 and as seen in FIG. 6 along 5—5 in FIG. 4, within mounting structure 50 is driven sprocket 59, which the teeth of which engage endless digging chain 62 during its rotation. Endless chain 62 is engaged to idler sprocket 64 at the furthest most end for endless rotation between driven sprocket 62 and idler sprocket 64 during the rotation of hydraulic motor 53. As is illustrated in side view in FIG. 3, endless chain 60 would further engage a lower idler sprocket 66, the rotation of which shall be explained further.

Endless chain 62, as is illustrated in FIGS. 1 through 3, and in particular FIG. 2, is comprised of a plurality of blade elements 63 spaced along the length of endless chain 63. Blade element 63, as seen in top view in FIG. 2, generally comprise a first and second blade attached to a link of chain 62, each of said blades 63 extending out onto a predetermined point on either side of link of chain 62, and, as is illustrated in blown-up view, curves back into chain 62 to define essentially a double cutting edge blade 63 on either side of chain 63. As is further illustrated in FIG. 2, the width of the blades in consecutive count along the length of chain 62 increase in width so that the amount of area trenched out by each subsequent blade 63 is broader than the amount trenched out by the preceding blade 63. In the entire length of the endless chain 62, there exists essentially two sets of blades 63 increasing in width so that one rotation of the endless chain 62 provides for the rotation of two sets of blades 63 during the one rotation of the chain 62. In the preferred embodiment, due to the type of terrain that this particular apparatus 10 is designed to trench out, this increasing width in the blade 63 enables the apparatus to trench out an area which progressively allows it to trench out a wider area during the rotation of the blades 63 and, therefore, does not require that the entire trench be trenched out by a single blade 63 on its first stroke into the terrain.

As is further illustrated in FIG. 3, endless chain 62 extending out to distal idler wheel 64, determines the length of the chain extending out from the cutter apparatus 50 itself. As is further illustrated in FIG. 3, idler wheel 64 is mounted upon extention boom arm 70 which provides support for idler wheel 65 to secure chain 62 in the extended state during operation. Extention boom 70 has the ability to be extended out by movement of lower portion 71, which is engaged within the exterior of main portion 70, which would simply add additional lengths in chain 62 to the predetermined length that one would wish to extend arm 70 outward. The extention of boom 70 outward would increase the depth in which cutter apparatus 50 would trench out within the bottom area of the body of water.

Figure 5:
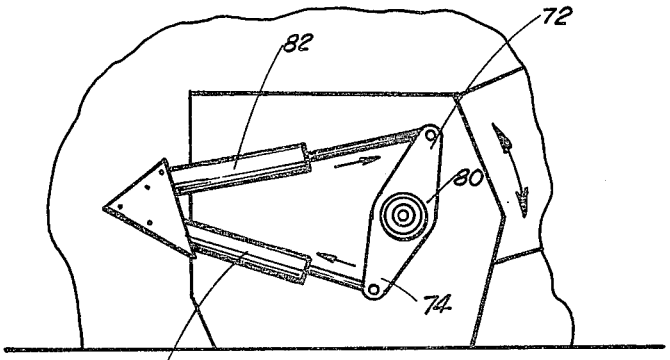
FIG. 5 is a partial view of the hydraulic means for moving the cutter mechanism of the preferred embodiment of the apparatus of the present invention.

As is illustrated in FIG. 2 from top view, cutter apparatus 50 is so mounted that trenching chain 62 is mounted substantially within the central portion between pontoons 30 and 32 along I-beam spacer means 40. In order to obtain the desired depth of the area trenched out by endless chain 62, there is provided, as illustrated in FIG. 5, a means for movement of digging apparatus 50 from a position substantially parallel with pontoons 30 and 32 as seen in phanthom view in FIG. 3 to a position substantially perpendicular to pontoon 30 and 32 as further illustrated FIG. 3. As was earlier explained, in FIG. 3, there can be seen a shaft 58 which accommodates the rotation of driven sprocket wheel 59, and which is supported by support frame 50 onto the bottom portion of I-beam spacer means 40, as is illustrated in FIG. 3. Shaft 58, as seen in top view in FIG. 2, extends across support frame 50 to the second wall of support frame 50 for support throughout the frame. Located on the second end of shaft 58 and coaxial with driven sprocket 59, opposite the driven sprocket 59, is rocker means 80, as illustrated in FIG. 5. Rocker assembly 80 is essentially a duel extention means supported in its center on shaft 58, so that movement of rocker assembly 80 imparts direct movement of cutter means 50, there being integral connection thereto between rocker assembly means 80 and cutter means 50. As further illustrate in FIG. 5, there is provided hydraulic linkage 72 on the upper most extention arm of rocker assembly 80, and hydraulic linkage 74 on the lower most extention arm of rocker assembly 80, the hydraulic linkage feeding into hydraulic cylinders 82 and 84 as further provided in FIG. 5. Hydraulic cylinders 82 and 84 are provided with hydraulic fluid extending from lines 24, as illustrated in FIG. 1, from a power source on barge 12. Thus, the activation of either hydraulic arm 82 or 94 in the preferred embodiment would create opposite movement of the hydraulic arms, thus moving the apparatus from a position horizontal to vertical or back to horizontal, depending on the extending and depression of hydraulic arms 82 and Therefore, in the preferred embodiment, the depth of trench 90, as illustrated in top view in FIG. 2, can be regulated by the positioning of rocker assembly 80, so that the depth of cutting apparatus 50 is regulated, and thus the desired depth of trench 90 is obtained. This desired depth of trench 90 is desired at various depths, due to the fact that certain types of pipe must be placed into a certain depth trench, in order to meet requirements both for the oil companies and for the Environmental Protection Agency.

Figure 4:
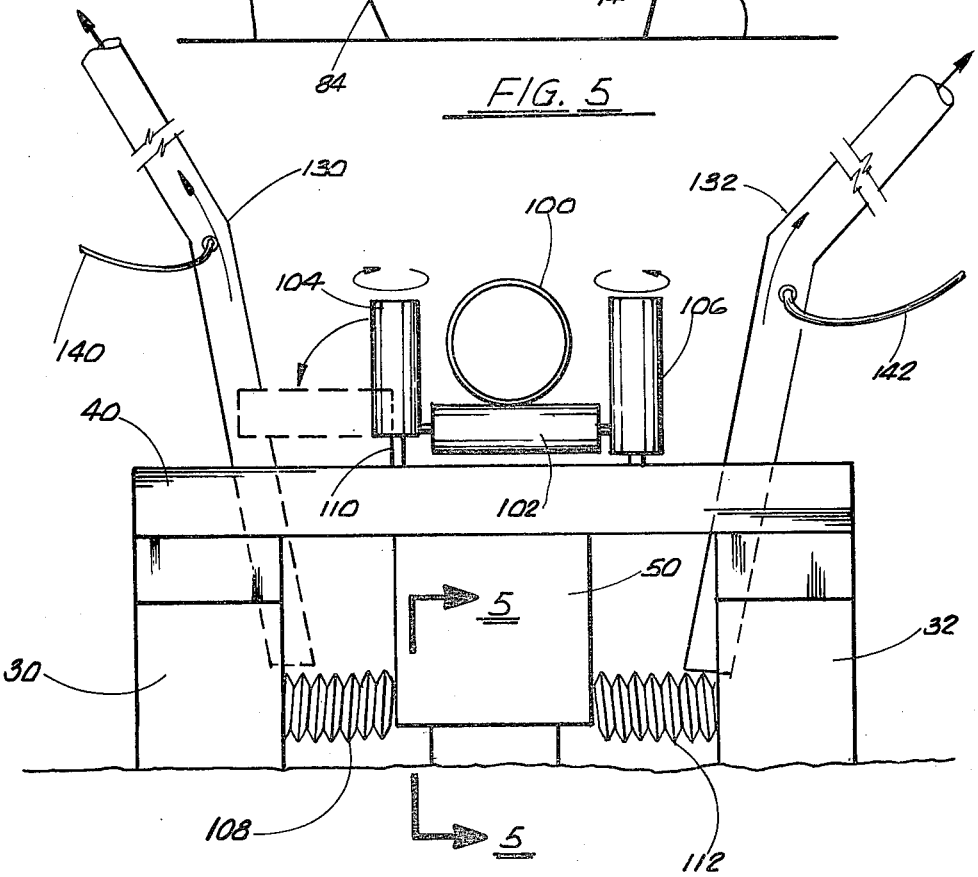
FIG. 4 is an end view along lines 4—4 in FIG. 2 of the preferred embodiment of the apparatus of the present invention illustrating the pipe roller means.

FIG. 4 illustrates the roller assembly means 92 for maintaining pipe 100 along the length of the pontoons upon the I-beam spacer means as illustrated in side view in FIG. 3 and in front view in FIG. 4. Roller spacer means includes a first horizontally disposed roller 102 which is rotatably mounted on the top side of each of spacer means 40 along the length of the pontoons 30 and 32. There is placed adjacent to each horizontal roller 102 a left vertical roller 104 and right vertical roller 106, which are rotatably mounted in the vertical position along the top portion of I-beam spacer means 40, so that if, in the movement of the pipe along the I-beams and resting on the vertical roller 102, the pipe 100 should have a tendency to slide off of horizontal roller 102, left vertical roller 104 or right vertical roller 106, as the case may be, would engage the pipe 100 as it moved along, and would rotate thus allowing movement of the pipe and disallowing the pipe to slip off of roller 102. As is further illustrated in FIG. 4, in order to fascilitate the placement of the length of pipe 90 upon roller 102, there is provided that left roller 104 would have the ability to swivel downward into a horizontal position via hinge means 110. As is illustrated in phantom view in FIG. 4, in order to more easily place length of pipe 100 upon roller 102, and not have to go over the vertical height of roller 104 in the preferred embodiment, that height being substantially between 12 and 24 inches in height, and due to the excessive weight of pipe 100, this positioning of roller 104 into the horizontal in order to place the pipe 100 upon roller 102 would require less effort. Of course, after pipe 100 has been placed upon roller 102, vertical roller is retained back into the vertical position, and a cotter pin or the like is set on the hinge means 110, in order to maintain roller 104 in the upright position during the movement of the pipe along I-beam spacer means 40 and roller assembly means 100.

During the trenching process, as is illustrated in side view in FIG. 3, a substantial amount of debris in terms of mud and substantially solid rock 120 (FIG. 2) is brought to the surface from the trenched out area. Often times this trenched out dirt and rock will accumulate amongst the top portion of cutter apparatus 50, thus often times causing blockage of the movement of the endless chain 62 through the idler wheels 64 and 66 or driven sprocket 59. In order to eliminate this problem, there is further provided left auger 108 and right auger 112 (See FIG. 2) which are mounted upon shaft 65, which accommodates lower idler wheel 66 in the preferred embodiment. Therefore, as idler wheels 64 and 66 are rotated by the movement of endless chain 62 through its cycle, this likewise imparts rotation of augers 108 and 112 on both the left and right sides of endless chain 62 at the point directly above the entrance or the movement of trenched out mud and dirt above the surface. Augers 108 and 112 would then move the accumulation of mud and dirt 120 laterally away from the cutter means 50, and that area between the cutter means 50 and the pontoons 30 and 32 create substantially less interference with cutter means 50. This movement of dirt and mud is further illustrated in FIG. 3, and would prevent the cutter means 50 or the like from jamming up and thus reducing lost time in use of the apparatus.

In an additional embodiment of apparatus 10, as illustrated in phantom view in FIGS. 3 and 4, there is illustrated air lift means 130 and 132 which generally comprise a pair of rigid extention pipes rigidly attached to I-beam spacer means 40, the lower end of which are adjacent the augers 108 and 112, and the upper portion of which extent outward and away from the pontoons 30 and 32 of apparatus 10. In this particular embodiment, air line 140 and 142 would feed into the interior of extention pipes 130 and 132 respectively, with compressed air being forced into extender pipes 130 and 132, directed toward the upper end of said pipes. Preferably, the air would be fed at approximately 600 cubic feet per minute. The extender pipes would be two 6 inch width pipes approximately 20 feet in length. In operation, with the air being directed upward into pipes 130 and 132, this would create a vacuum at the lower end of pipes 130 and 132, and would pull the debris away from augers 108 and 112, and deposited through the upper ends of pipes 130 and 132 away from the apparatus. In this particular embodiment, these pipes would serve as a secondary means for removing the accumulation of a trenched out material during the trenching process. Of course, the air from air lines 140 and 142 would be from a source, preferably an air compressor 148, located on barge 112.

Because many varying and different embodiments may be made within the scope of the inventive concept herein taught, and because many modifications may be made in the embodiments herein detailed in accordance with the descriptive requirement of the law, it is to be understood that the details herein are to be interpeted as illustrative and not in a limiting sense.

What is claimed as invention is:

1. An underwater trenching and pipe laying apparatus, comprising:

a. an underwater support frame positioned beneath the pipe to be laid;

b. digging means attached to said frame for digging a trench into soil beneath said frame;

c. power means for driving said digging means;

d. means interconnecting said digging means and said power means for imparting rotation to said digging means when said power means is driven;

e. roller assembly means mounted to said frame for receiving a continuous length of pipe atop said frame, and aligning said pipe with said trench and depositing said pipe into said trench; said roller assembly means further comprising:

i. a plurality of horizontally disposed rollers rotatably mounted on the upper surface of said frame;

ii. left and right vertically disposed rollers, said rollers rotatably mounted adjacent each of said horizontally disposed rollers; said vertically disposed rollers guiding said pipe along said frame, and said horizontally disposed rollers serving as means for allowing said frame to move along and beneath said pipe;

iii. means for maneuvering at least one of said vertically disposed rollers from an operative vertical position to an inoperative horizontal position;

iv. means for securing said vertical roller into said operative vertical position; and v. auger means for moving spoils dug from said trench away from both sides of said digging means.

2. The apparatus of claim 1, further comprising mounting means for mounting said digging means to said frame.

3. The apparatus of claim 1, further comprising hydraulic means to maneuver said digging means between a non-digging position substantially parallel with said frame and a digging position substantially perpendicular to and below said frame.

4. The apparatus of claim 1, further comprising air lift means for lifting said spoils away from said digging means during the digging process;

5. The apparatus of claim 1, wherein said support frame further comprises a pair of spaced apart elongated pontoons, said pontoons maintained substantially in parallel relation by a plurality of wide flange beam space means.

6. The apparatus of claim 1, wherein said digging means further comprises:

a. a mounting frame for mounting said digging means onto said wide flange beam spacer means;

b. an endless cutter chain, having a plurality of cutting members spaced along said chain, for digging various widths of the trench to be dug, during the rotation of said endless cutter chain;

c. a driven sprocket mounted upon said mounting frame for driving said endless cutter chain;

d. boom means mounted to said mounting frame, said boom means extending between said driven sprocket and said endless chain, for selectively positioning said endless chain to various lengths;

e. hydraulic power means for rotating said driven sprocket, with the rotation of said driven sprocket imparting rotation to said endless cutter chain.

7. The apparatus in claim 2, wherein said mounting means comprises a mounting frame rigidly mounted to at least a pair of said wide flange beam spacer means.

8. The apparatus in claim 3, wherein said hydraulic means comprises a hydraulic motor mounted upon said floating means.

9. The apparatus in claim 1, wherein said auger means are positioned substantially perpendicular to said digging assembly, for moving spoils substantially horizontally away from said digging assembly.

10. The apparatus in claim 4, wherein said air lift means comprises:

a. a pair of substantially elongated pipe sections rigidly connected to at least one of said wide flange beam spacer means, said rigid pipe means being substantially vertically disposed at the lowermost end of said pipe adjacent said auger and the upper end of said pipe extending above and away from said pair of elongated pontoons;

b. air injection means inserted into said pipe for injecting pressurized air up said pipe, said pressurized air creating a vacuum at the lowermost end of said pipe;

c. air source means for providing a source of said pressurized air.

11. An apparatus for digging trenches and laying pipe in underwater locations which comprises:

a. movable floating barge means;

b. an under water sled connected to said floating barge means and positioned beneath a section of the pipe to be laid, said sled comprising a pair of spaced apart, elongated pontoons, said pontoons rigidly maintained in substantially parallel position by a series of I-beam spacer means;

c. digging assembly means attached to a portion of the I-beam spacer means, said digging assembly means comprising:

i. mounting means for mounting said digging assembly means onto said I-beam spacer means;

ii. endless chain cutting means, having a plurality of cutting members spaced along the length thereof, for trenching various widths of the trench to be dug, during the rotation of said endless chain;

iii. driven sprocket means mounted upon said support means for driving said endless chain;

iv. extendor means mounted to said support means and engaged the distal end portion of said endless chain, for electively positioning said endless chain to various lengths;

d. power means for driving said driven sprocket means during the trenching process;

e. auger means for depositing debris away from said trenching means during the trenching process; and f. roller assembly means mounted to said frame for receiving a continuous length of pipe along said frame, and aligning said pipe with said trench and depositing said pipe into said trench; said roller assembly means further comprising:

i. a plurality of horizontally disposed rollers rotatably mounted on the upper surface of said frame;

ii. left and right vertically disposed rollers, said rollers rotatably mounted adjacent each of said horizontally disposed rollers; said vertically disposed rollers guiding said pipe along said frame, and said horizontally disposed rollers serving as means for allowing said frame to move along and beneath said pipe;

iii. means for maneuvering at least one of said vertically disposed rollers from an operative vertical position to an inoperative horizontal position;

iv. means for securing said vertical roller into said operative vertical position; and v. auger means for moving spoils dug from said trench away from both sides of said digging means.

* * * * *